US009555869B1

(12) United States Patent
Arbuckle et al.

(10) Patent No.: US 9,555,869 B1
(45) Date of Patent: Jan. 31, 2017

(54) SYSTEMS AND METHODS FOR SETTING ENGINE SPEED IN A MARINE PROPULSION DEVICE

(71) Applicant: Brunswick Corporation, Lake Forest, IL (US)

(72) Inventors: Jason S. Arbuckle, Horicon, WI (US); Steven J. Andrasko, Oshkosh, WI (US); Andrew J. Przybyl, Berlin, WI (US); William P. O'Brien, Eden, WI (US); Kenneth G. Gable, Oshkosh, WI (US); David M. Van Buren, Fond du Lac, WI (US); Gene A. Smedema, Princeton, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/610,377

(22) Filed: Jan. 30, 2015

(51) Int. Cl.
*F02D 11/10* (2006.01)
*B63H 21/21* (2006.01)
(Continued)

(52) U.S. Cl.
CPC ..... *B63H 21/213* (2013.01); *B63H 21/14* (2013.01); *F02D 9/08* (2013.01); *B63H 2021/216* (2013.01)

(58) Field of Classification Search
CPC .. B63H 21/213; B63H 2021/216; F02B 61/04; F02B 61/045; F02D 9/08; F02D 11/10; F02D 28/00; F02D 35/00; F02D 35/0007; F02D 41/26; F02D 2041/141; F02D 2041/1412
(Continued)

(56) References Cited

U.S. PATENT DOCUMENTS 4,939,660 A 7/1990 Newman et al.
5,080,064 A 1/1992 Buslepp et al.
(Continued)

FOREIGN PATENT DOCUMENTS

WO 00/68744 11/2000

OTHER PUBLICATIONS

Newport, Motion Control Coordinate System, www.newport.com, pp. 7-2 through 7-25, website visited Nov. 18, 2014.
(Continued)

*Primary Examiner* — John Kwon
*Assistant Examiner* — Johnny H Hoang
(74) *Attorney, Agent, or Firm* — Andrus Intellectual Property Law, LLP

(57) ABSTRACT

A method for setting an engine speed of an internal combustion engine in a marine propulsion device of a marine propulsion system to an engine speed setpoint includes determining the engine speed setpoint based on an operator demand and predicting a position of a throttle valve that is needed to achieve the engine speed setpoint. The method also includes determining a feed forward signal that will move the throttle valve to the predicted position, and after moving the throttle valve to the predicted position, adjusting the engine speed with a feedback controller so as to obtain the engine speed setpoint. An operating state of the marine propulsion system is also determined. Depending on the operating state, the method may include determining limits on an authority of the feedback controller to adjust the engine speed and/or determining whether the operator demand should be modified prior to determining the engine speed setpoint.

23 Claims, 8 Drawing Sheets

(51) Int. Cl.
*B63H 21/14* (2006.01)
*F02D 9/08* (2006.01)

(58) Field of Classification Search
USPC ..... 701/85, 110; 123/319, 327, 339.12, 123/339.15, 339.16, 339.19, 339.23, 344, 123/352, 3, 99
See application file for complete search history.

(56) References Cited

U.S. PATENT DOCUMENTS 5,836,851 A 11/1998 Ruman
5,848,582 A 12/1998 Ehlers et al.
6,009,371 A 12/1999 Kobayashi
6,152,102 A 11/2000 Ruman
6,234,853 B1 5/2001 Lanyi et al.
6,273,771 B1 8/2001 Buckley et al.
6,298,824 B1 10/2001 Suhre
6,425,370 B1 7/2002 Kramer
6,561,016 B1 5/2003 Suhre et al.
6,587,765 B1 7/2003 Graham et al.
6,701,890 B1 3/2004 Suhre et al.
6,757,606 B1 6/2004 Gonring
7,163,000 B2 * 1/2007 Ishida ..... F02D 9/1065 123/395
7,214,110 B1 5/2007 Ehlers et al.
7,357,120 B2 4/2008 Kaji
7,473,149 B2 1/2009 Mizokawa
7,556,547 B2 7/2009 Kaji
7,917,283 B2 3/2011 Kado
7,976,354 B2 7/2011 Kubota et al.
8,340,847 B2 12/2012 Sako et al.
8,762,022 B1 6/2014 Arbuckle et al.
8,777,681 B1 7/2014 Mcnalley et al.
9,039,468 B1 5/2015 Kirchhoff et al.
9,156,536 B1 10/2015 Arbuckle et al.
9,248,898 B1 2/2016 Kirchhoff et al.
2002/0086593 A1 7/2002 Shidara et al.
2003/0000500 A1 1/2003 Chatfield
2003/0027468 A1 2/2003 Into
2003/0054704 A1 3/2003 Kanno
2003/0109184 A1 6/2003 Kanno
2003/0120360 A1 6/2003 Yasui et al.
2004/0069271 A1 * 4/2004 Kanno ..... F02B 61/045 123/396
2004/0069272 A1 * 4/2004 Allen ..... F02D 41/0087 123/406.23
2006/0047406 A1 * 3/2006 Chatfield ..... F02D 11/105 701/104
2006/0166573 A1 7/2006 Vetta et al.
2008/0051979 A1 * 2/2008 Yasui ..... F01L 13/0047 701/105
2008/0280511 A1 * 11/2008 Kado ..... B63H 21/213 440/1
2010/0191397 A1 7/2010 Nose et al.
2011/0202258 A1 8/2011 Fukushima et al.
2011/0297462 A1 12/2011 Grajkowski et al.
2012/0191275 A1 7/2012 Clever et al.
2013/0035009 A1 2/2013 Kuriyagawa et al.

OTHER PUBLICATIONS

Mercury Marine, SmartCraft Manual, p. 11, May 2012.
U.S. Appl. No. 14/104,291, filed Dec. 12, 2013.
U.S. Appl. No. 14/284,795, filed May 22, 2014.
U.S. Appl. No. 14/573,202, filed Dec. 17, 2014.
Beauregard, Brett, "Improving the Beginner's PID: Reset Windup", Project Blog, http://brettbeauregard.com/blog/2011/04/improvingthebeginner%E2%80%99spidresetwindup/, website visited Jul. 20, 2016, available at least as early as Jul. 22, 2011.

* cited by examiner

SYSTEMS AND METHODS FOR SETTING ENGINE SPEED IN A MARINE PROPULSION DEVICE

FIELD

The present disclosure relates to marine propulsion systems for use on marine vessels, and more specifically to systems and methods for setting an engine speed of an internal combustion engine of a marine propulsion device in a marine propulsion system.

BACKGROUND

U.S. Pat. No. 6,234,853, hereby incorporated by reference herein, discloses a docking system which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

U.S. Pat. No. 8,762,022, hereby incorporated by reference herein, discloses a system and method for efficiently changing controlled engine speed of a marine internal combustion engine in a marine propulsion system for propelling a marine vessel. The system responds to the operator changing the operator-selected engine speed, from a first selected engine speed to a second-selected engine speed, by predicting throttle position needed to provide the second-selected engine speed, and providing a feed forward signal moving the throttle to the predicted throttle position, without waiting for a slower responding PID controller and/or overshoot thereof, and concomitant instability or oscillation, and then uses the engine speed control system including the PID controller to maintain engine speed at the second-selected engine speed.

U.S. Pat. No. 8,777,681, hereby incorporated by reference herein, discloses systems for maneuvering a marine vessel that comprise a plurality of marine propulsion devices that are movable between an aligned position to achieve of movement of the marine vessel in a longitudinal direction and/or rotation of the marine vessel with respect to the longitudinal direction and an unaligned position to achieve transverse movement of the marine vessel with respect to the longitudinal direction. A controller has a programmable circuit and controls the plurality of marine propulsion devices to move into the unaligned position when a transverse movement of the marine vessel is requested and to thereafter remain in the unaligned position after the transverse movement is achieved. Methods of maneuvering a marine vessel comprise requesting transverse movement of the marine vessel with respect to a longitudinal direction and operating a controller to orient a plurality of marine propulsion devices into an unaligned position to achieve the transverse movement, wherein the plurality of marine propulsion devices remain in the unaligned position after the transverse movement is achieved.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a method for setting an engine speed of an internal combustion engine in a marine propulsion device of a marine propulsion system to an engine speed setpoint. The method includes determining the engine speed setpoint based on an operator demand and predicting a position of a throttle valve of the engine that is needed to achieve the engine speed setpoint. The method also includes determining a feed forward signal that will move the throttle valve to the predicted position, and after moving the throttle valve to the predicted position, adjusting the engine speed with a feedback controller so as to obtain the engine speed setpoint. An operating state of the marine propulsion system is also determined, and depending on the operating state, the method further comprises at least one of: determining limits on an authority of the feedback controller to adjust the engine speed; and determining whether the operator demand should be modified prior to determining the engine speed setpoint.

Another example of the present disclosure is of a marine propulsion system for setting an engine speed of an internal combustion engine in a marine propulsion device to an engine speed setpoint. The system includes a throttle valve controlling an amount of air provided to the engine and an input device for inputting an operator demand. An electronic control unit determines an engine speed setpoint based on the operator demand, predicts a position of the throttle valve that is needed to achieve the engine speed setpoint, and determines a feed forward signal that will move the throttle valve to the predicted position. A feedback controller adjusts the engine speed so as to obtain the engine speed setpoint after the throttle valve has been moved to the predicted position. The electronic control unit determines an operating state of the marine propulsion system. Depending on the operating state, the electronic control unit further determines at least one of: limits on an authority of the feedback controller to adjust the engine speed; and whether the operator demand should be modified prior to determination of the engine speed setpoint.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed. Each of the examples of systems and methods provided in the FIGURES and in the following description can be implemented separately, or in conjunction with one another and/or with other systems and methods.

Prior Art

Figure 1:
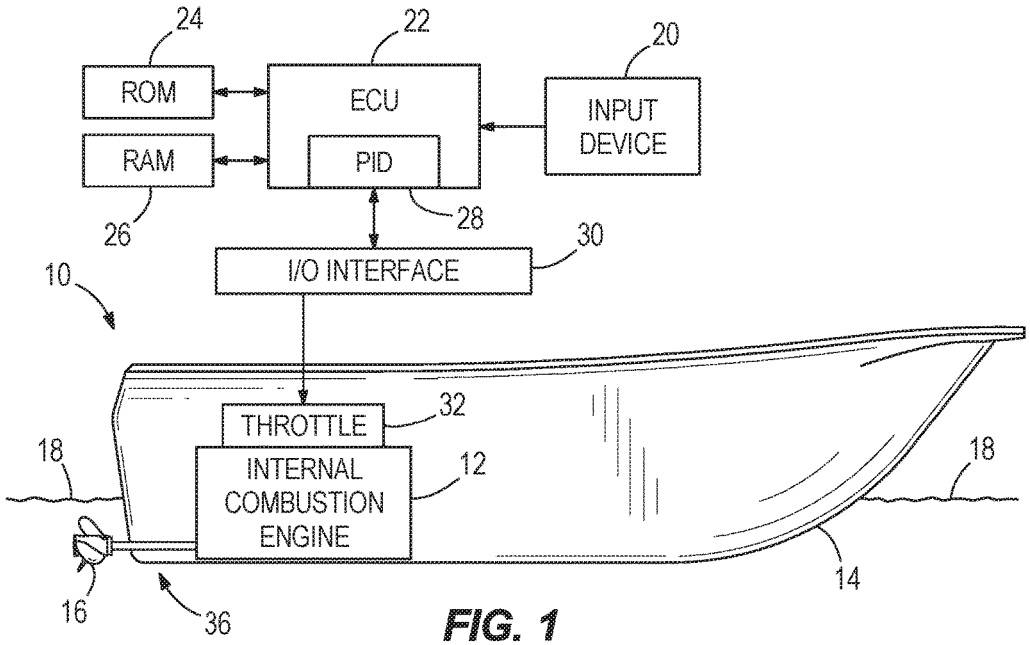
FIG. 1 PRIOR ART
FIG. 1 is a schematic illustration of a marine propulsion system known in the prior art.

FIG. 1 shows a marine propulsion system 10 having an internal combustion engine 12 for propelling a marine vessel 14, e.g. by way of propeller 16, in a body of water 18. Engine speed is set by the operator of the marine vessel 14 by using an input device 20, such as a throttle lever, joystick, or the like, to input an operator demand. An electronic control unit (ECU) 22 receives the engine speed command from the input device 20 and includes appropriate read only memory (ROM) 24 and random access memory (RAM) 26 and a processor for interpreting the engine speed command and processing it with a feedback controller 28, such as a proportional integral derivative (PID) controller or a PI controller. Feedback controller 28 outputs a control signal to input-output (I/O) interface 30, which in turn supplies a control signal to internal combustion engine 12, including throttle valve 32, which controls engine speed according to throttle position. By way of control with the feedback controller 28, the ECU 22 maintains engine speed at the operator-selected engine speed.

In response to the operator changing the operator-selected engine speed at input device 20 from a first-selected engine speed to a second-selected engine speed, the ECU 22 sends a signal to move the throttle valve 32 to a new position to attempt to set the engine speed to the second-selected engine speed. However, this type of system is subject to overshoot, particularly with large speed changes, when attempting to set engine speed to the second-selected engine speed in response to the noted change by the operator of the selected engine speed at input device 20. To accommodate various changes, including large changes, the feedback controller 28 is provided with enough amplification gain to provide a desired response time to accommodate the change in the first-selected engine speed to the second-selected engine speed at input device 20. The higher the amplification gain, the quicker the response time; however, higher gain makes the system 10 subject to more overshoot and instability.

Present Disclosure

Figure 2:
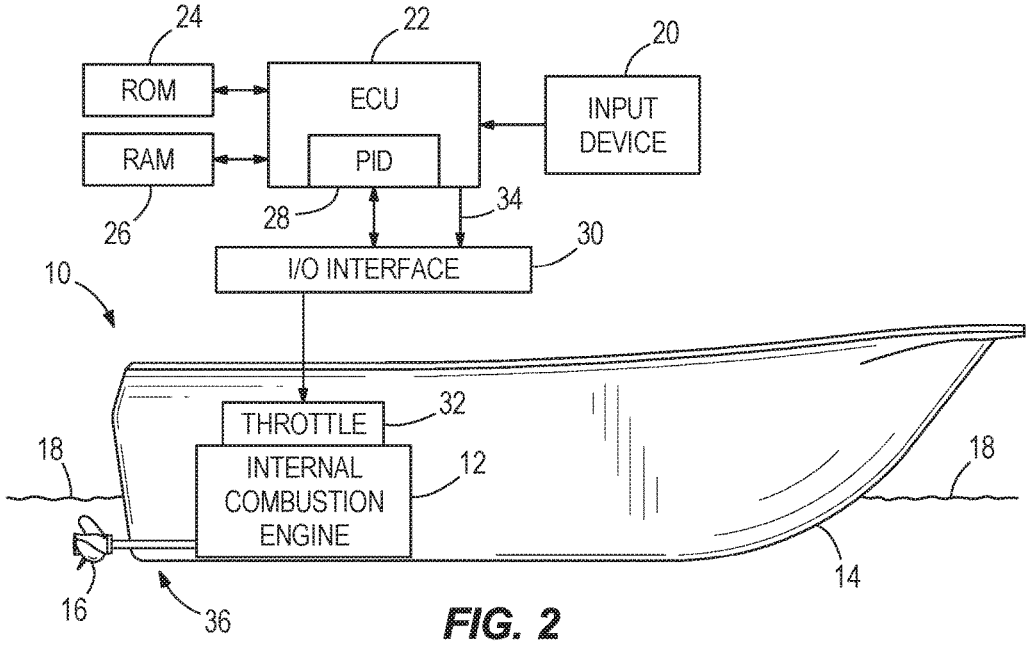
FIG. 2 is like FIG. 1, but shows a marine propulsion system according to the present disclosure.

Referring to FIG. 2, in the present system, in response to the operator changing the operator-selected engine speed at input device 20 from a first-selected engine speed to a second-selected engine speed (engine speed setpoint), a prediction is made as to the position of the throttle valve 32 needed to provide the second-selected engine speed setpoint. A feed forward signal is then provided at 34, which feed forward signal bypasses feedback controller 28, and moves throttle valve 32 to the predicted throttle valve position. After movement of the throttle valve 32 to the predicted throttle valve position, the feedback controller 28 corrects the position of the throttle valve 32 as needed so as to obtain and maintain the engine speed at the second operator-selected engine speed. Throttle valve 32 is therefore moved to the predicted throttle position in response to the feed forward signal at 34, without waiting for the input of the feedback controller 28 to move the throttle valve 32, thereby decreasing or eliminating any overshoot otherwise caused by the system. The system of FIG. 2 thereby enables reduction of the amplification gain of the feedback controller 28 otherwise needed to accommodate the change from the first-selected engine speed to the second-selected engine speed at input device 20, and instead accommodates such change by the predicted throttle position provided by the feed forward signal 34. The feedback controller amplification gain need only be large enough to maintain engine speed at the second-selected engine speed, without having to accommodate the change from the first-selected engine speed to the second-selected engine speed. The reduced amplification gain provides enhanced stability of the feedback controller 28 and reduces oscillation of the system.

The present disclosure therefore includes marine propulsion system 10 for setting an engine speed of an internal combustion engine 12 in a marine propulsion device 36 to an engine speed setpoint. The system 10 includes a throttle valve 32 controlling an amount of air provided to an intake manifold of the engine 12 and an input device 20 for inputting an operator demand. The input device 20 may comprise any of a throttle lever, a joystick, a touchpad, buttons, etc., as will be described with respect to FIG. 3, and the operator demand can be in the form of a value read from a potentiometer, a numerical value input via digital interface, or any other type of input known to those having ordinary skill in the art.

Returning to FIG. 2, the ECU 22 determines an engine speed setpoint based on the operator demand, predicts a position of the throttle valve 32 that is needed to achieve the engine speed setpoint, and determines a feed forward signal 34 that will move the throttle valve 32 to the predicted position. The ECU 22 then outputs the feed forward signal to a throttle valve actuator, such as a motor geared to the throttle valve 32. A feedback controller 28 adjusts the engine speed so as to obtain the engine speed setpoint after the throttle valve 32 has been moved to the predicted position. The present disclosure provides an advantage in that the ECU 22 is able to determine the engine speed setpoint and the authority of the feedback controller 28 based on a particular operating state of the system 10. Depending on the operating state, the ECU 22 further determines at least one of: (a) limits on an authority of the feedback controller 28 to adjust the engine speed; and (b) whether the operator demand should be modified prior to determination of the engine speed setpoint. Doing so provides several advantages as described herein below.

Figure 3:
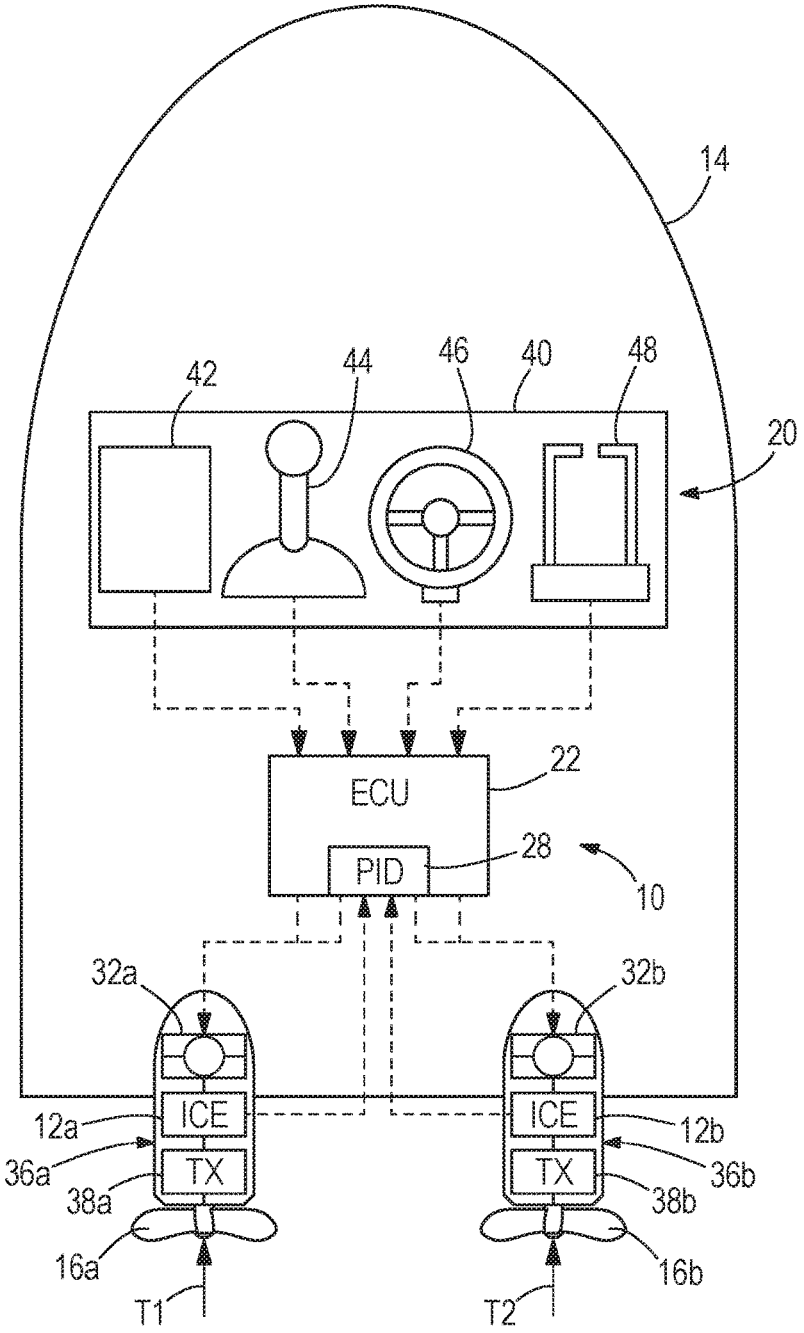
FIG. 3 is a schematic illustration of a marine vessel having two marine propulsion devices, according to another example of the present disclosure.

FIG. 3 illustrates a schematic view of a marine vessel 14 provided with two marine propulsion devices 36*a*, 36*b*. It should be understood that although the marine propulsion device shown in FIGS. 1 and 2 is an inboard drive, and outboard drives are shown in FIG. 3, the present disclosure applies equally to all types of marine drives: inboards, outboards, stem drives, etc. Returning to FIG. 3, each marine propulsion device 36*a*, 36*b* has a throttle valve 32*a*, 32*b* that controls an amount of air entering an internal combustion engine (ICE) 12*a*, 12*b* of each marine propulsion device. The internal combustion engines 12*a*, 12*b* are operatively connected to propellers 16*a*, 16*b* by way of transmissions 38*a*, 38*b*. The rotation of the propellers 16*a*, 16*b* by the internal combustion engines 12*a*, 12*b* via the transmissions 38*a*, 38*b* produces thrusts T1, T2, respectively. The direction of thrusts T1, T2 depends on a direction of rotation of the propellers 16*a*, 16*b* as determined by the transmissions 38*a*, 38*b*, and depends on a rotational angle of the marine propulsion devices 36*a*, 36*b* about steering axes extending vertically through each one of the respective marine propulsion devices 36*a*, 36*b*.

The amount of air entering the intake manifolds of the internal combustion engines 12*a*, 12*b* is controlled by the throttle valves 32*a*, 32*b*, which in one example are electronic throttle valves in signal communication with the ECU 22. The ECU 22 may also be in signal communication with the transmissions 38*a*, 38*b* in order to control whether and in what direction the propellers 16*a*, 16*b* turn, i.e. whether the marine propulsion device 36*a*, 36*b* is in neutral, forward, or reverse.

The ECU 22 may include a memory (ROM 24, RAM 26, see FIG. 2) and a programmable processor. As is conventional, the processor can be communicatively connected to a computer readable medium that includes volatile or non-volatile memory upon which computer readable code is stored. The processor can access the computer readable code, and the computer readable medium upon executing the code carries out functions as described herein below. In other examples of the system 10, more than one control unit is provided, rather than the single ECU 22 as shown herein. For example, a separate control unit could be provided in order to interpret signals sent from a helm 40 of the marine vessel, and separate control units could be provided for each marine propulsion device 36*a*, 36*b*. It should be noted that the dashed lines shown in FIG. 3 are meant to show only that the various control elements are capable of communicating with one another, and do not represent actual wires connecting the control elements, nor do they represent the only paths of communication between the elements. Further, the communications shown herein could be wired (for example, via a serially wired CAN bus) or wireless.

The helm 40 includes a number of user input devices, such as an interactive video display 42, a joystick 44, a steering wheel 46, and a throttle lever 48. Each of these devices inputs commands to the ECU 22. The ECU 22 interprets these commands and in turn communicates with the propulsion devices 36*a*, 36*b*, such as for example to provide commands regarding the magnitude and direction of thrusts T1, T2 produced by the propulsion devices 36*a*, 36*b*.

As mentioned above, the ECU 22 determines an operating state of the marine propulsion system 10, and depending on the operating state, determines at least one of: (a) limits on an authority of the feedback controller 28 to adjust the engine speed; and (b) whether the operator demand should be modified prior to determination of the engine speed setpoint. Various different operating states and the response of the ECU 22 to detection of one or more of these operating states will now be described with respect to FIGS. 4-8. At the outset, it is worth noting that the system 10 can be in more than one operating state at once, and that the systems and methods described with reference to FIGS. 4-8 can be combined with one another in various amalgamations.

Figure 4:
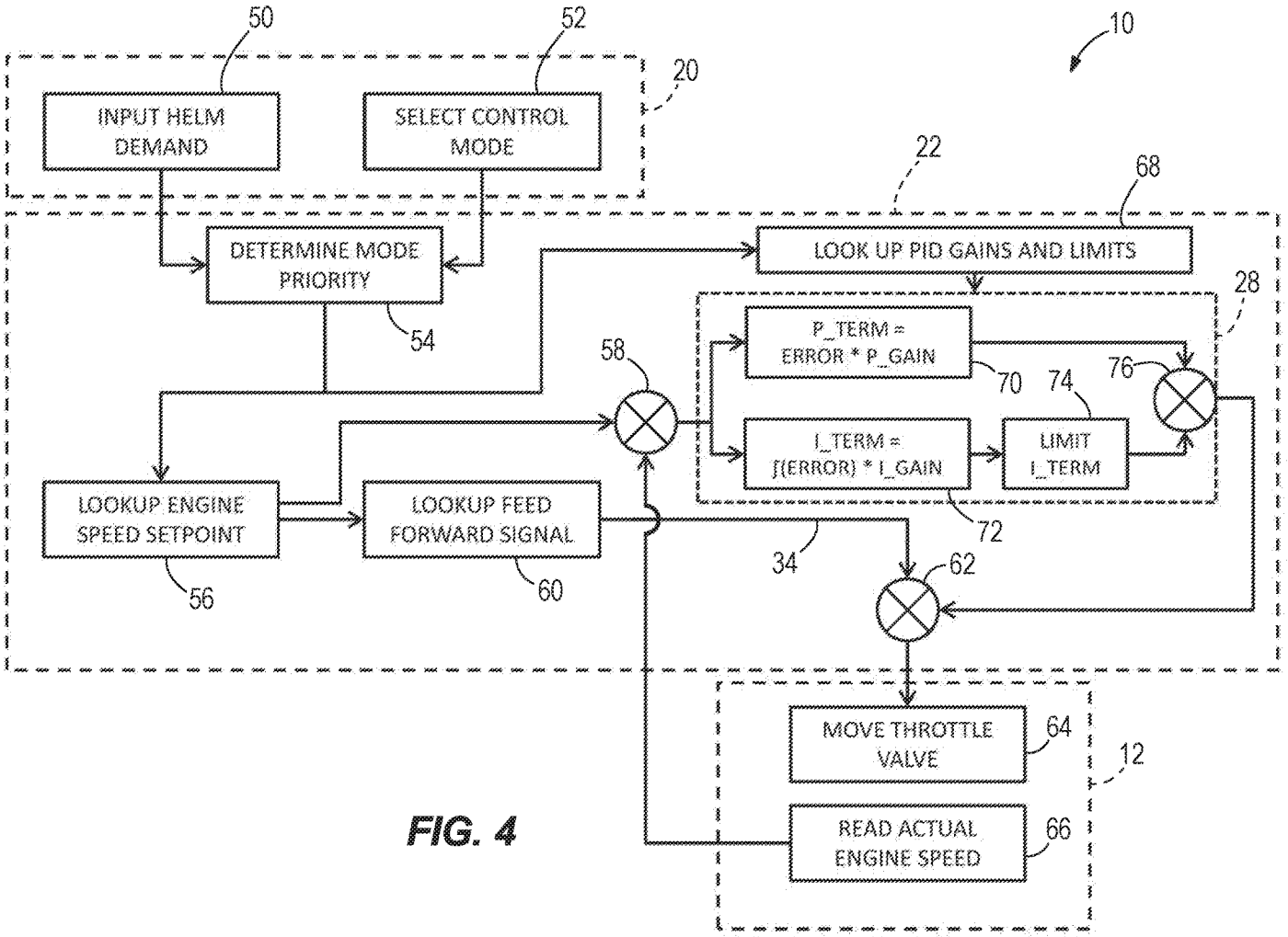
FIGS. 4-7 are schematic diagrams of systems and associated methods according to several examples of the present disclosure.

Turning to FIG. 4, an example in which the operating state comprises operation in an operator-selected control mode will be described. According to this example, the same feedback controller 28 is used for each operator-selected control mode in a plurality of operator-selected control modes in which the marine propulsion system 10 may be operated. In this example, the ECU 22 selects the limits on the authority of the feedback controller 28 based on the particular operator-selected control mode in which the system is currently operating. By an "operator-selected control mode," the present disclosure refers to any one of a number of control modes for operating one or more propulsion devices 36 aboard the marine vessel 14.

For example, a propulsion device 36 could be operated in a trolling mode, in which the speed of the propeller 16 is reduced to trolling-like speeds. The propulsion devices 36*a*, 36*b* could be operated in an auto sync mode, in which a speed of a first internal combustion engine 12*a* (the "peer" engine) of the marine propulsion system 10 is synchronized to a speed of a second internal combustion engine 12*b* (the "master" engine) of the marine propulsion system 10. The system could be operated in a joysticking mode, in which input from the joystick 44 is converted to a desired magnitude and direction of thrust of the internal combustion engine 12, and in which the marine propulsion devices 36*a*, 36*b* can rotate around their steering axes to effect directional changes, lateral movement, or various other maneuvers for the marine vessel 14, as described in U.S. Pat. No. 6,234,853, or U.S. Pat. No. 8,777,681, which were incorporated by reference herein above. The system 10 could be operated in a helm demand mode, in which a position of the throttle lever 48 determines a magnitude and direction of thrust of the marine propulsion device 36, while a position of the steering wheel 46 controls steering of the marine vessel 14. Other operator-selected control modes include cruise control, in which both engines 12*a*, 12*b* are provided with the same setpoint speed, and launch control, in which an operator can select a desired aggressiveness of the vessel's launch profile, as described in U.S. Pat. No. 7,214,110, or in U.S. patent application Ser. No. 14/104,291, filed on Dec. 12, 2013, both of which are hereby incorporated by reference herein. Various other modes that provide special features for operation of the marine propulsion system 10 could also be provided, and the control modes described herein are not limiting on the scope of the present disclosure.

As mentioned above, the limits on the authority of the feedback controller 28 to adjust the engine speed depend on the operator-selected control mode, as shown by the diagram of FIG. 4. At box 50, the operator inputs a helm demand, for example by manipulating an input device 20. The operator may additionally or alternatively select a control mode using the input device 20, as shown at box 52. As described herein above, the control mode can be any of a joysticking mode, auto sync mode, trolling mode, etc. Because the same feedback controller 28 is used for each control mode and because some marine propulsion systems can be operated in more than one control mode at once, the ECU 22 next determines at box 54 which control mode's gains, limits, and setpoint source should be used to control the speed of the engine 12 based on a hard-coded or calibratable priority of the control modes. For example, the system 10 may be in both cruise control mode and auto sync mode at the same time, but because cruise control mode and auto sync mode may be provided with different PID gains, limits, and engine speed setpoints, it is necessary to determine which gains, limits, and setpoint source will be used to control the engine speed. In one example, cruise control mode and launch control mode have priority over both auto sync mode and helm control mode, and auto sync mode may have priority over helm control mode. Prioritizing cruise control mode over auto sync or helm control mode is important because in auto sync mode, the peer engine may hunt around to match the speed of the master engine. This is to be avoided when the system is in cruise control mode, and both the peer and master engine are provided with the same engine speed setpoint already.

After the priority of one control mode over another is determined at box 54, the engine speed setpoint corresponding to the operator's demand and the prioritized control mode is looked up at box 56. In one example, a given operator demand will correspond to a given engine speed setpoint no matter which control mode is prioritized. The engine speed setpoint is thereafter sent to a summer 58 as well as to box 60, where a lookup table or other map is used to determine the feed forward signal 34. The feed forward signal 34 is passed through a summer 62 to move the throttle valve 32 to the predicted position, as shown at box 64. At box 66, the actual (current) engine speed is read, for example using a tachometer, and the actual speed is fed back to the summer 58. Summer 58 outputs a difference between the engine speed setpoint determined at box 56 and the actual engine speed determined at box 66, and inputs this to the feedback controller 28.

Meanwhile, the PID gains and limits are determined at box 68, which PID gains and limits are also based on the prioritized control mode determined at box 54. The PID gains include both a P-term gain and an I-term gain. The gains may be determined based on the engine speed setpoint and the engine speed error, determined at box 56 and summer 58, respectively. The P-term gain is multiplied by the engine speed error to output a P-term, as shown at box 70. The I-term gain is multiplied by the integral of the engine speed error to output an I-term, as shown at box 72. As shown in box 74, the limits determined at box 68 are then used to limit the I-term. The limits are provided as a maximum limit that the I-term cannot exceed, and minimum limit that the I-term cannot fall below. In other words, if the feedback controller 28 calculates an I-term at box 72 that is outside the limits, the I-term is set at the limited amount (i.e., at the maximum limit if the I-term is positive, or at the minimum limit if the I-term is negative). In other examples, the ECU 22 may look up limits to be applied to the P-term as well. The (perhaps limited) I-term and P-term are then summed at summer 76, and provided as the output of the feedback controller 28. (Although derivative control is not explicitly shown in FIG. 4, it is to be understood that such control can be provided as well.) The output of feedback controller 28 is supplied to summer 62, which adds the output to the feed forward signal from box 60 in order to adjust the position of the throttle valve 32, as shown at box 64.

As mentioned above, the i-term limits may be different for different control modes. For example, it may be desirable to provide maximum and minimum limits that are farther apart (thus providing more authority to the feedback controller 28 to adjust the speed of the engine) when operating in auto sync mode, where the peer engine is attempting to match the speed of the master engine, than when operating in helm mode. For example, it may be that the master engine can achieve the setpoint speed with only 25% throttle, while the peer engine may need much more throttle to reach the setpoint speed. Opening up the 1-term limits allows the feedback controller 28 more authority to affect the speed of the peer engine by increasing its throttle up to the maximum limit (which limit is particular to auto sync mode, and determined at box 68) until its speed matches the speed of the master engine. If separate control units (and therefore separate feedback controllers) are provided for each engine 12*a*, 12*b*, then the limits on one feedback controller's authority can be changed without affecting the limits on the other feedback controller's authority, which is helpful when one engine is weaker than the other. Other modes, such as joysticking, troll, cruise control, etc. may have different limits (determined at box 68) and may therefore provide different levels of authority to the feedback controller 28 depending on the control mode in which the system 10 is operating.

The system 10 is also provided with a way to shift between different limits on the authority of the feedback controller 28 when the operator switches from one control mode to another. In one example, the ECU 22 waits to switch from a first operator-selected control mode to a second operator-selected control mode until the operator demand (input at box 50) is less than an upper demand limit associated with the second operator-selected control mode. For example, if the operator is switching from auto sync mode to helm demand mode, and the current operator demand in auto sync mode is higher than the limits particular to helm demand mode would allow, the ECU 22 will wait until the operator has requested a demand (at box 50) that would be achievable in the helm demand mode, according to the limits particular to the helm demand mode, before transitioning to the helm demand mode.

FIG. 4 therefore illustrates a system 10 in which the same feedback controller 28 is used for any given operator-selected control mode that might be chosen by an operator, and in which box 54 represents a client selector that selects particular gains and limits for use by the feedback controller 28 based on the particular operator-selected control mode. Such a system minimizes the complexity of having unique controllers for each operator-selected control mode, with unique authorities and gains for each mode. The system 10 therefore decreases the possibility that something is missed during calibration because the calibrator will not have to calibrate many unique governors, some of which may have been sequential in the previous state of the art. In the present system, only one feedback controller 28 is always active, so there is no need to initialize or reset I-terms, to ramp P-terms, etc. Instead, with box 54 acting as a client selector, the client selector determines priority of one control mode over another based on a combination of hard-coded and calibratable thresholds. Thereafter, the client selector provides only one engine speed setpoint source and only one set of PID gains and maximum and minimum limits for use by the ECU 22.

Figure 5:
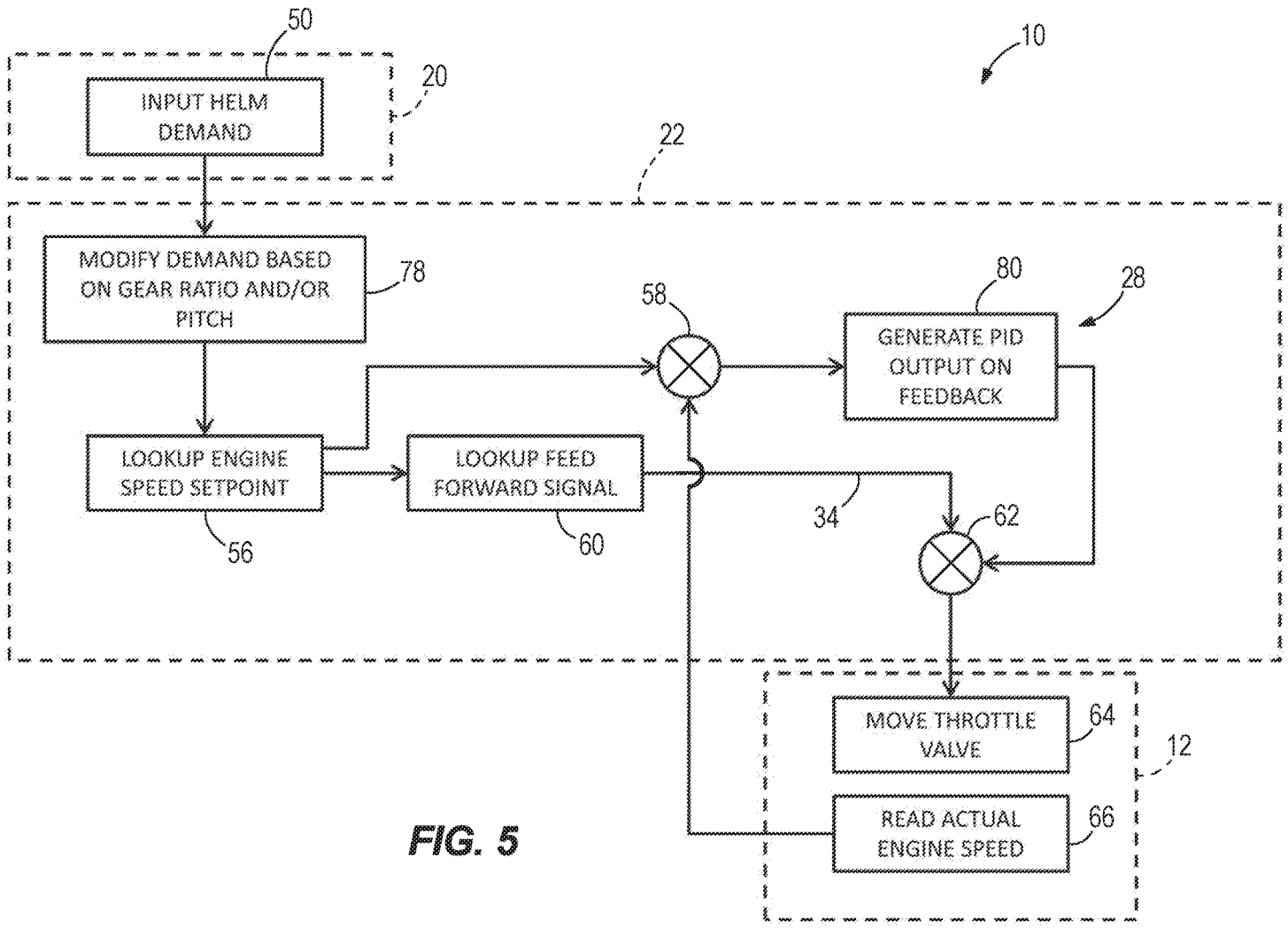

FIG. 5 illustrates an example of the system 10 in which the operating state comprises operation in a joysticking mode, in which, as described above, a direction and magnitude of thrust of the marine propulsion device 36 are determined based on a position of a joystick 44. The below description of FIG. 5 also applies to operation of the system in any operating mode where commands to the ECU 22 are interpreted as joystick commands, such as electronic anchoring or commands input via a touchpad. As shown at box 50, the operator inputs a helm demand, in this example, by manipulation the joystick 44. As the operator does so, he is not necessarily thinking in terms of providing an engine speed setpoint to the system 10. Rather, he is thinking in terms of a particular thrust that he would like the marine propulsion devices 36*a*, 36*b* to provide. For example, if the operator pushes the joystick further in a forward direction, he would like the marine propulsion devices 36*a*, 36*b* to provide increasingly more thrust in the forward direction. If he manipulates the joystick to one side or another, he is requesting that the marine propulsion devices 36*a*, 36*b* provide thrust to propel the marine vessel 14 sideways. In some cases, depending on the way the operator manipulates the joystick, the marine propulsion devices 36*a*, 36*b* may even provide thrusts in different directions from one another. For example, as described in the above-referenced joysticking patents, marine propulsion device 36*a* may provide a thrust in a forward direction while marine propulsion device 36*b* provides a thrust in a reverse direction.

However, because marine propulsion devices 36*a*, 36*b* have different efficiencies when they are operating in forward gear versus in reverse gear, and because the marine propulsion devices have been calibrated to provide particular thrusts based on a particular movement of the joystick, the gear ratio and pitch of the propellers 16*a*, 16*b* on the marine propulsion devices 36*a*, 36*b* can affect the response of the system. If the operator demand input by the joystick 44 is mapped to an engine speed setpoint using a map that was calibrated for a propeller with a different pitch and/or gear ratio, this may cause very low pitch propellers to seem to lack authority, while high pitch propellers may seem overly aggressive and potentially prone to blowing out. The present inventors have realized that in order to eliminate the need for an operator to close the loop between what he has requested and the actual response of the system, the operator demand from the joystick 44 could be modified prior to determining the engine speed setpoint so as to account for one of a gear ratio and pitch of a propeller 16 of the marine propulsion device 36 when the marine propulsion system 10 is operating in the joysticking mode.

In one example, the ECU 22 is programmed such that it can modify the operator demand based on gear ratio and/or pitch, as shown at box 78. To do so, the ECU 22 may be programmed with a specific torque multiplier that depends on the gear ratio of the marine propulsion device 36 provided on the marine vessel 14. To account for the specific gear ratio of the marine propulsion device, the ECU 22 may modify the operator demand by multiplying it by the torque multiplier programmed into the memory of the ECU 22 prior to passing along this modified demand to box 56, where the ECU 22 would then determine the engine speed setpoint. The same method could be used to modify the operator demand based on the pitch of the propeller 16. Alternatively, rather than having a given multiplier based on the propeller pitch programmed into the system, the multiplier could be instead be determined from a lookup table or similar map that accepts the joystick demand and pitch of the propeller as inputs, and outputs a correction factor by which the operator demand is to be multiplied prior to passing the modified demand on to box 56, where the ECU determines the engine speed setpoint.

Similar to FIG. 4, the engine speed setpoint is thereafter sent to a summer 58, as well as used to look up a feed forward signal as shown at box 60. The feed forward signal is passed through summer 62 and used to move the throttle valve, as shown at box 64. The speed of the engine is then read at box 66 and provided to summer 58, which outputs a difference between the actual engine speed and the engine speed setpoint from box 56. This difference is sent to the feedback controller 28, which generates PID output on the feedback, as shown at box 80. The PID output is sent to summer 62, and the summation of the feed forward signal from box 60 and the PID output from box 80 are used to adjust the position of the throttle valve 32.

The system of the present disclosure therefore provides the responsiveness and repeatability of an engine whose speed is governed by a feed forward signal, with the intuitive feel of a thrust response proportionate to operator demand input by a joystick 44. It should be noted that while the method of the present system is shown as being carried out by a general ECU 22, the method could alternatively be carried out by a separate control unit located at the helm 40 of the marine vessel 14.

Figure 6:
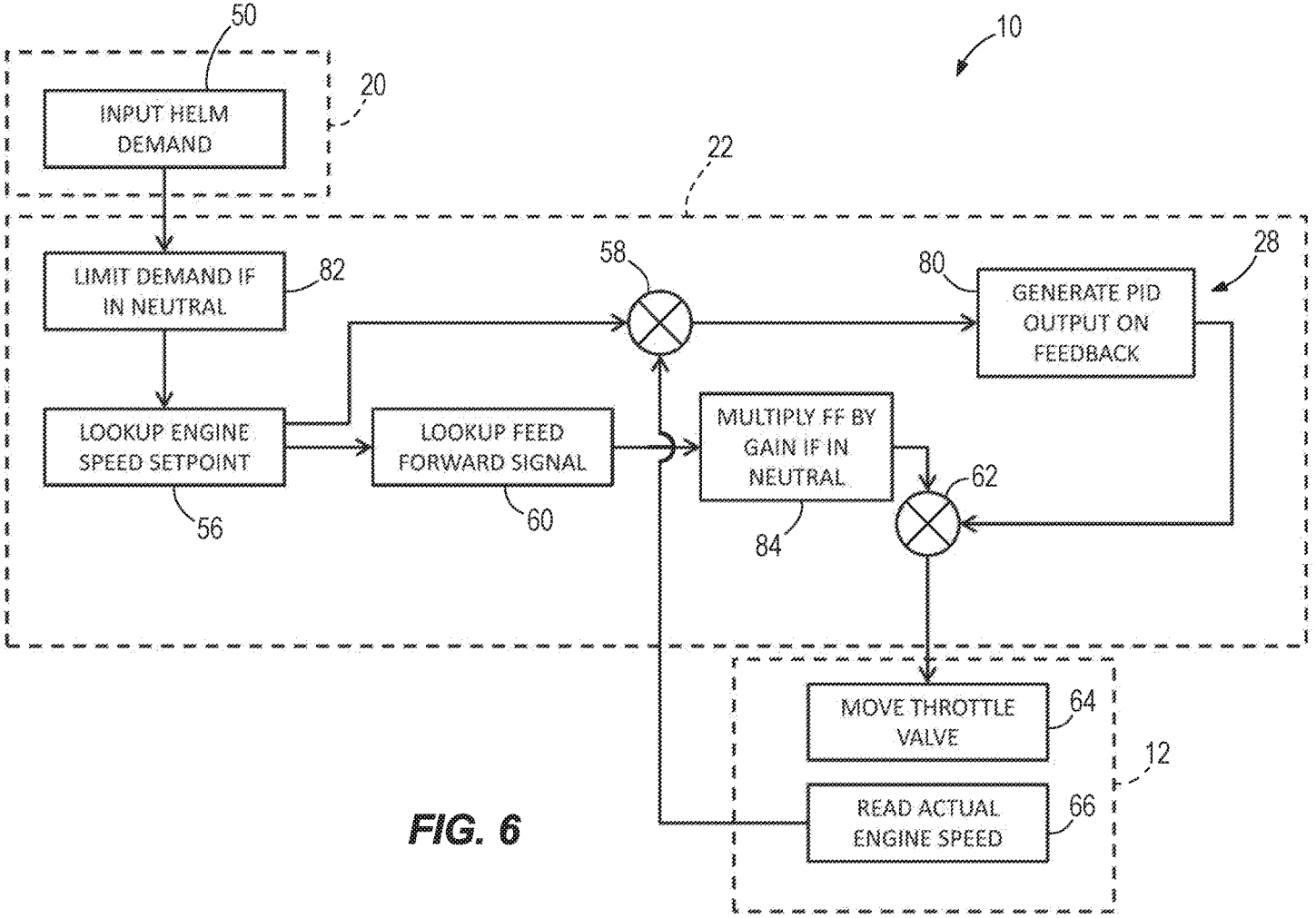

FIG. 6 shows an example of the system 10 in which the operating state comprises operation in a throttle-only mode, in which the operator demand can be varied while the engine 12 is in neutral. To enter the throttle-only mode, the operator of the marine vessel 14 may place the throttle lever 48 in neutral and thereafter select a "throttle only" button, such as one provided on a track pad or on the interactive video display 42. It should be understood that many other methods could be used to enter the throttle-only mode, and the above described method is merely one example. Once the system 10 is in the throttle-only mode, the operator may move the throttle lever 48 to increase or decrease the speed of the engine 12 while the transmission 38 is in neutral. This means that no torque will be transmitted to the propeller 16 and the operator can therefore increase or decrease the speed of the engine 12 without effecting any movement of the marine vessel 14. Because the propeller 16 is not spinning however, there is no load on the rotating engine 12, and the engine 12 can be revved to very high speeds by very little movement of the throttle lever 48. In prior systems, the ECU 22 would command cylinder cuts to control the maximum engine speed that could be achieved while the marine propulsion device 36 was in neutral. According to prior methods, the ECU would essentially mis-fire the engine's cylinders when the engine speed exceeded a particular threshold. If the engine speed exceeded the engine speed threshold, the software would cut the cylinders, the engine speed would fall below the threshold, and all cylinders would be re-enabled. This prior method has drawbacks, one of which is that the cylinder cut-based rev limiter is very loud and often alarms the operator. Additionally, it can make other diagnostics, such as neutral switch diagnostics, give false positives.

In contrast, the present system 10 limits engine speed by using the throttle valve 32, which provides smooth engine speed control. The present system does so by determining whether the operator demand, input at box 50, exceeds a predetermined threshold while the marine propulsion system 10 is operating in the throttle-only mode. If the operator demand does not exceed the predetermined threshold, the demand is passed through to box 56, where the engine speed setpoint is determined. If the operator demand does exceed the predetermined threshold, the present system modifies the operator demand by capping it at the predetermined threshold, as shown at box 82, prior to determining the engine speed setpoint. This capped value is thereafter passed to box 56, where the engine speed setpoint is determined. In one example, the operator demand is capped at a value that would translate to an engine speed setpoint of 3500 RPM. This method therefore catches an operator demand that would otherwise cause the cylinder cut rev limiter to kick in prior to that operator demand ever being passed through to determine an engine speed setpoint or to look up the feed forward signal that will move the throttle valve. The cylinder cut rev limiter method remains in place to handle situations when the speed of the engine 12 needs to be cut very quickly, for example when the marine vessel 14 jumps a wave.

After the engine speed setpoint is determined at box 56, the setpoint is sent through to the summer 58, as described herein above. The engine speed setpoint is also sent to box 60, where the feed forward signal is determined. In one example, the feed forward signal is determined from a look up table or map that is the same table or map used when the system is operating in forward gear. If this is the case, the method then continues to box 84, where the feed forward signal is multiplied by a fractional gain if the system is in neutral. In one example, the fractional gain is 0.25 to 0.3. Multiplying the feed forward signal that would otherwise be used if the system were in forward gear by a fractional gain ensures that a large feed forward signal is not passed through summer 62 to move the throttle valve, as shown at box 64, while still providing the benefits of using a feed forward signal (as opposed to merely PID control) described above with respect to FIG. 2. In an alternative example, no feed forward signal is provided, and the system rather relies on the feedback controller 28 generating PID output on the feedback as shown at box 80 to achieve the engine speed setpoint.

Figure 7:
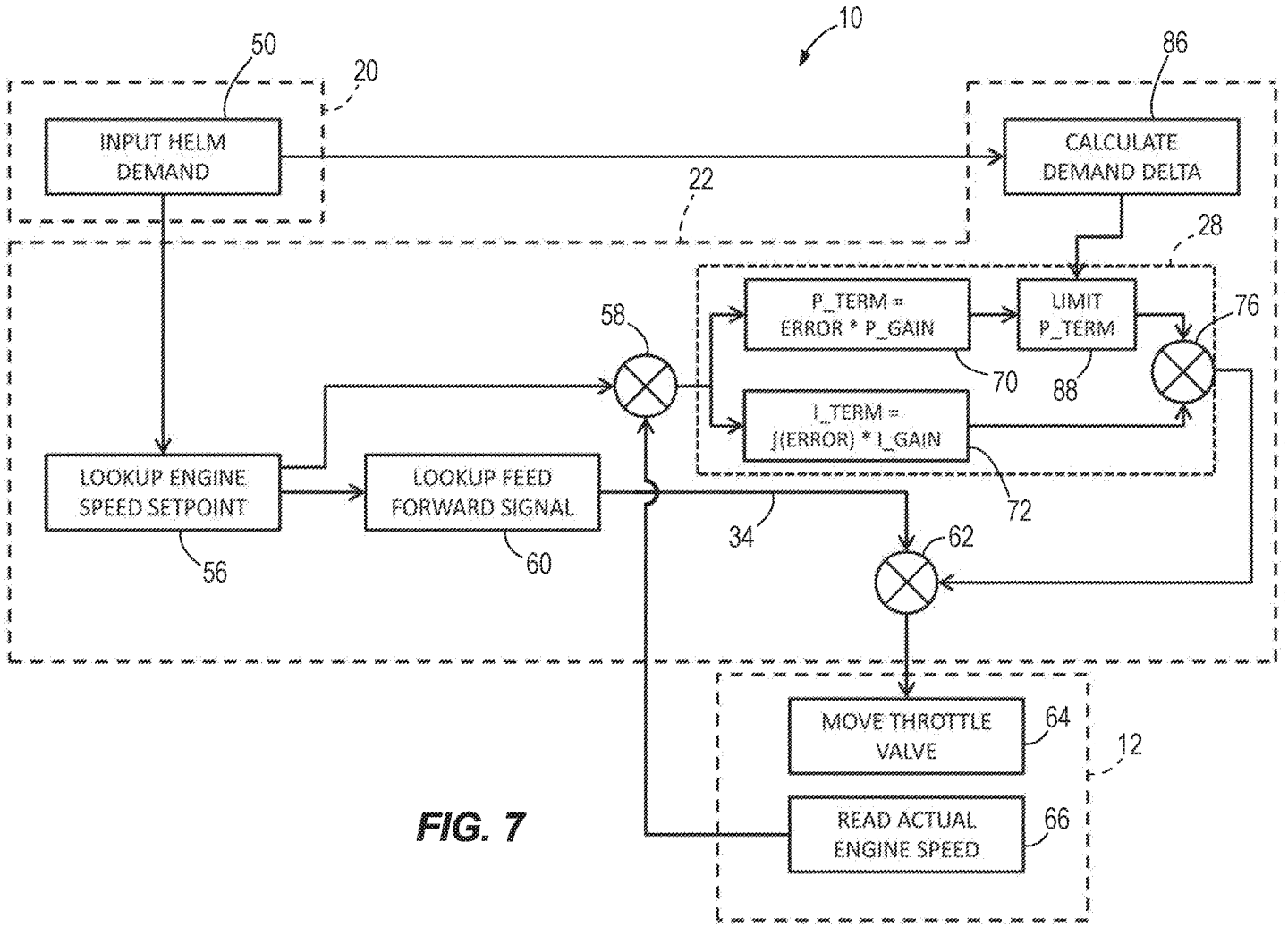

Turning now to FIG. 7, an example of the system 10 in which the operating state comprises one of acceleration of the engine speed and deceleration of the engine speed will be described. The system 10 shown in FIG. 7 provides a way to damp a response of the throttle valve 32 during transient conditions, when the engine speed is increasing or decreasing. A system that utilizes a feed forward term to achieve an engine speed setpoint as shown in FIG. 2 provides excellent responsiveness when the engine speed is increasing, because the PID control provided by feedback controller 28 can increase the position of the throttle valve 32 beyond the required throttle angle during the transient. One problem with this is that the same PID control can result in engine speed decreasing transients that are too aggressive for drivability. For example, if the feedback controller 28 commands the throttle valve 32 to shut quickly to a low value (in response to the operator pulling back a significant amount on the throttle lever 48) the actual engine speed will drop below the desired setpoint, and the feedback controller 28 will then have to command the throttle valve 32 to open again to reach the setpoint. This dip and recovery of engine speed taxes the system. The initial drop due to the feedback control also translates to an abrupt boat speed change, which can cause the operator to lunge forward.

The above-described effect is largely dominated by the proportional control term (P-term) of the feedback controller 28. The system in FIG. 7 therefore provides a method for limiting the P-term of the feedback controller 28, although the I-term and/or D-term could also be limited. Limiting the P-term in effect limits the authority of the feedback controller 28 to adjust to the engine speed, and therefore provides a good response during transients. The system 10 determines the maximum and minimum limits on the P-term by calculating a demand delta, as shown at box 86, which will be described herein below with reference to FIG. 8. The demand delta is thereafter used to limit the P-term as shown at box 88, which P-term was calculated by the feedback controller 28 as the error multiplied by the proportional gain factor, as shown at box 70. If the P-term exceeds a maximum, it is limited to the maximum; it if it is lower than a minimum, it is limited to the minimum. The P term is thereafter added at summer 76 to an I-term calculated at box 72. The output of the feedback controller 28 from summer 76 is passed to summer 62 and is combined with the feed forward signal 34 from box 60 to move the throttle valve, as shown at box 64.

Figure 8:
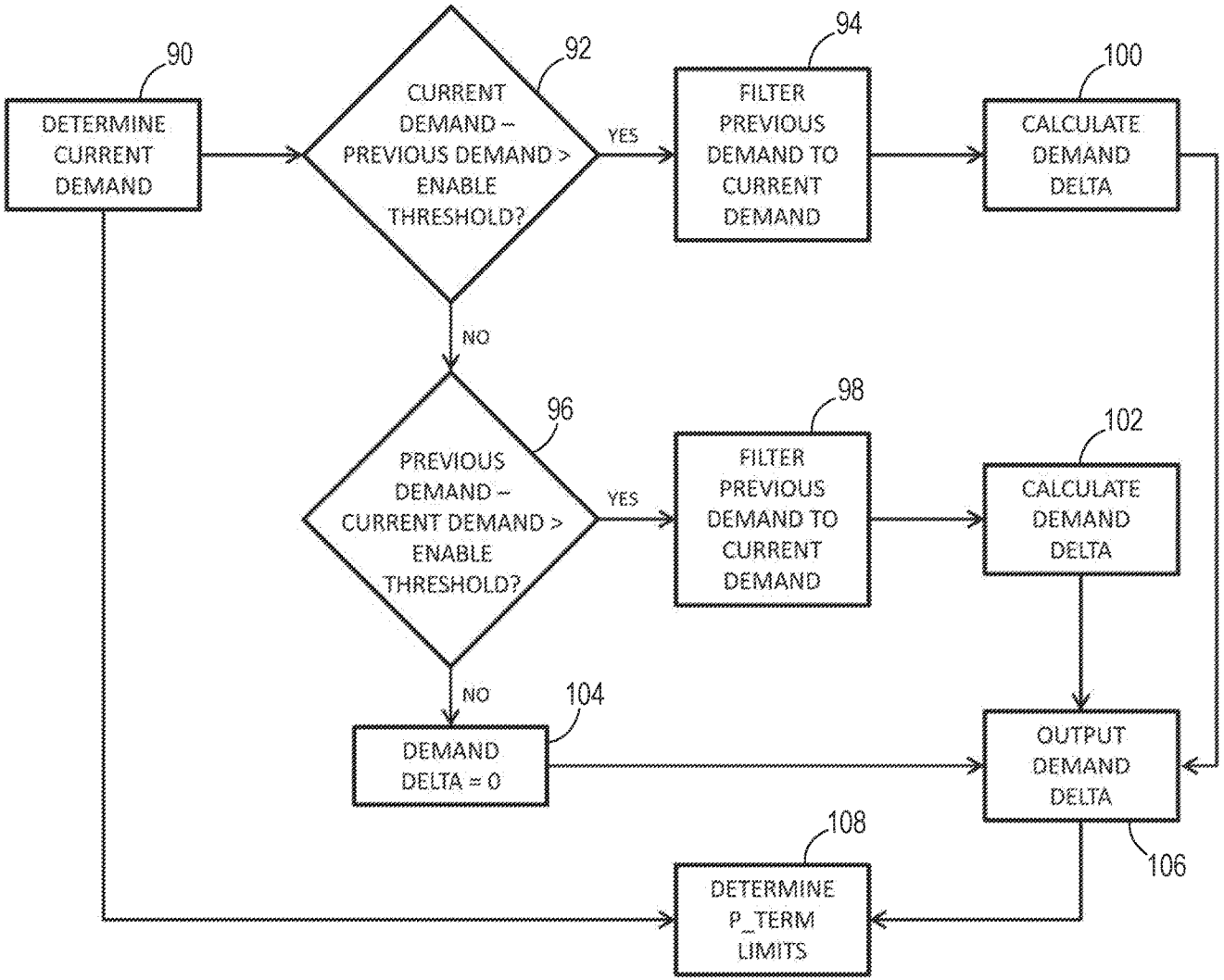
FIG. 8 is a flow chart showing further details of a method associated with the diagram shown in FIG. 7.

Turning now to FIG. 8, the method of box 86 in FIG. 7 will be further described. This method includes calculating a demand delta between a current operator demand and a previous operator demand, and using the demand delta and the engine speed setpoint to determine the limits on the authority of the feedback controller 28 to adjust the position of the throttle valve 32. As shown at box 90, the method includes determining the current operator demand. In one example, this is the helm demand input by the operator using input device 20. The system's strategy starts in the disabled state. In this state, the strategy filters the current demand using a unique filter constant. In one example, the filter time constant is 2 seconds. Filtering of the current demand allows the ECU 22 to keep track of the filtered value so that the strategy can take a difference (i.e., calculate the demand delta) when the operator demand later changes. Otherwise, the software might not be able to catch a change in the operator demand. The filtered demand value therefore represents a previous operator demand that is stored by the ECU 22. The strategy will then compare a new current demand (after the demand changes) with the filtered demand value in order to determine if the software should remain in the disabled state, or if it should transition to a demand decreasing or a demand increasing state.

As mentioned, the strategy may exit the disabled state and transition into either a demand decreasing state or a demand increasing state. At decision block 92, the system determines whether the new current demand from input device 20 minus the previous (filtered) demand is greater than a particular enable threshold. If the answer is yes, then the system is in the demand increasing state and the method continues to box 94, where the previous demand is filtered to the current demand. In box 94, the strategy stores the previous (filtered) demand from the disabled state and calculates a difference between the filtered demand and the current operator demand. This difference is essentially filtered to zero as the filtered demand tends toward the current operator demand. The filter constant used to carry out the filtering in the demand increasing state is unique to this state, and in one example is a shorter time constant than the filter constant provided when the demand is decreasing. In one example, the filter time constant is 0.25 seconds.

Returning to decision point 92, if the current demand minus the previous (filtered) demand is not greater than the enable threshold, the method continues to decision point 96, and determines if the filtered demand minus the current demand is greater than the enable threshold. Requiring that the difference be greater than an enable threshold ensures that the remainder of the strategy is only carried out if the demand undergoes a large change, which could cause the above-described dip and recovery in engine speed. If the answer is yes, this means that the system is in the demand decreasing state, and the method continues to box 98, where the filtered demand is filtered to the current demand. In the demand decreasing state, the strategy stores the previous (filtered) demand from the disabled state and calculates a difference between the filtered demand and the current operator demand. This difference is filtered to zero as the filtered demand tends toward the current operator demand. The filter constant used is unique to the demand decreasing state, and in one example is a longer time constant than that used in the demand increasing state. Filtering with a longer time constant essentially means that the difference between the filtered and current demand remains greater for a longer period of time, as the filter is applied more slowly. In one example, the filter time constant is 3 seconds.

In one example, the filters applied in boxes 90, 92, and 96 are first order exponential filters that operate according to the equation: $y(k)=a*y(k-1)+(1-a)*x(k)$, where $x(k)$ is the raw input at time step k; $y(k)$ is the filtered output at time step k; and "a" is a constant between 0 and 1. In one example, $a=\exp(-T/\tau)$, where $\tau$ is the filter time constant, and T is a fixed time step between samples.

In either the demand increasing or demand decreasing state, after the filtered demand is filtered to the current demand, as shown at boxes 94 and 98, the method continues to boxes 100 and 102, respectively, where the demand delta is calculated. The demand delta equals the output of the continually filtered demand minus the current demand. In other words, the demand delta represents the remaining difference in demand before the filtering has been fully carried out. Because the system filters the previous (filtered) operator demand to the current operator demand, the demand delta progressively decreases.

Returning to decision block 96, if the previous demand minus the current demand is not greater than the enable threshold, then this means that the system is in neither the demand increasing nor the demand decreasing state, and therefore remains in the disabled state. The system thereafter sets the demand delta equal to zero, as shown at box 104.

Boxes 100, 102, and 104 thereafter lead to box 106, where the demand delta is output. This demand delta is thereafter used to determine the limits on the P-term, as shown at box 108. In one example, this is done by inputting the demand delta and the current user demand into a first lookup table or other similar map in order to determine the minimum P-term limits and into a second lookup table or map to determine the maximum P-term limits. The P-term limits determined at box 108 are thereafter used to limit the P-term, as shown at box 88 in FIG. 7.

In one example, the P-term limits tables provide the feedback controller 28 with less authority to adjust the engine speed during deceleration of the engine speed than during acceleration of the engine speed. This helps prevent the above-described dip and recovery problem, while still allowing aggressive acceleration. In another example, the feedback controller 28 is provided with increasingly more authority (as determined from the P-term limits tables) to adjust the engine speed as the demand delta progressively decreases while it is filtered out as described with respect to boxes 94 and 98. This ensures that during the initial stages of decreasing demand from the operator at the input device 20, the feedback controller 28 does not have a lot of authority to adjust the engine speed, but as the demand delta decreases, the feedback controller 28 is provided with increasingly more authority to achieve the current demand requested by the operator. The progressively decreasing demand delta and the engine speed setpoint are used to determine the authority limits of the feedback controller 28 during each iteration of control.

Other ways to exit the demand increasing or demand decreasing states may be provided, such as if the ECU 22 determines that the system is in an idle control state, in which the user has requested a demand that is so low it is effectively an idle demand. In this case, the system reverts to the disabled state and the idle controller takes over. In other examples, once the demand delta has decreased below a certain threshold, the system may exit the demand increasing or demand decreasing state and return to the disabled state, such that the actual engine speed can approach the engine speed setpoint as determined by the operator demand input without any limits.

It should be noted that the filtered demand kept track of according to the method of FIG. 8 is not passed through as the demand that is used to determine the engine speed setpoint. Rather, the filtered demand is tracked for purposes of calculating the P-term limits, as described with reference to box 108 of FIG. 8. Doing so provides good steady state control and good transient performance in the appropriate acceleration or deceleration directions.

Figure 9:
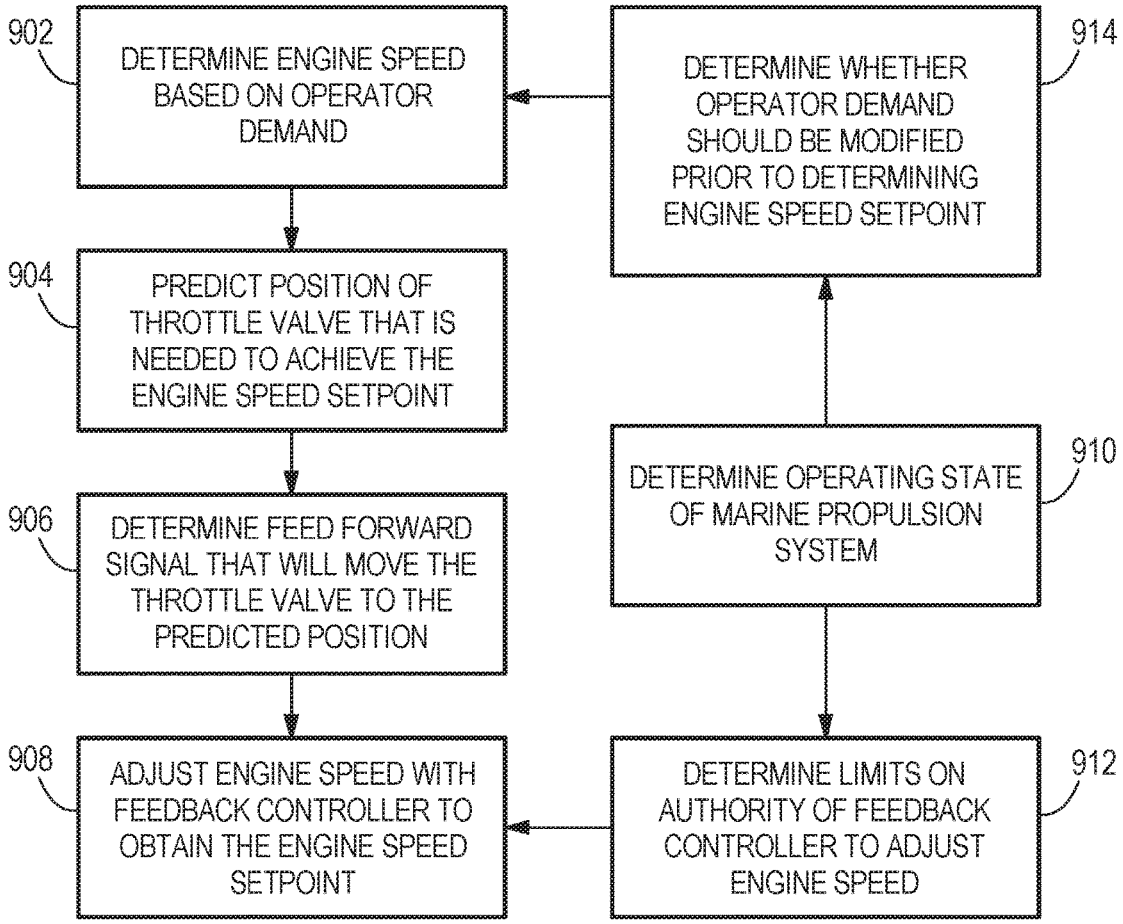
FIG. 9 illustrates a method for setting an engine speed of an internal combustion engine in a marine propulsion device according to the present disclosure.

Turning to FIG. 9, a further method according to the present disclosure will be described. As shown at 902, the method includes determining an engine speed setpoint based on an operator demand. As shown at 904, the method includes predicting a position of the throttle valve 32 of the engine 12 that is needed to achieve the engine speed setpoint. As shown at 906, the method then includes determining a feed forward signal that will move the throttle valve 32 to the predicted position. As shown at 908, after moving the throttle valve 32 to the predicted position, the method includes adjusting the engine speed with a feedback controller 28 so as to obtain the engine speed setpoint.

The method also includes, as shown at 910, determining an operating state of the marine propulsion system 10. Depending on the operating state, the method further comprises at least one of determining limits on an authority of the feedback controller 28 to adjust the engine speed, as shown at 912, and determining whether the operator demand should be modified prior to determining the engine speed setpoint, as shown at 914. The results of these determinations are applied to the determinations made at boxes 908 and 902, respectively.

In one example, the operating state comprises operation in an operator-selected control mode, and the method further comprises selecting the authority limits based on the operator-selected control mode. The method may further comprise waiting to switch from a first operator-selected control mode to a second operator-selected control mode until the operator demand is less than an upper demand limit associated with the second operator-selected control mode. This example is described here and above with respect to FIG. 4.

In another example, the operating state may comprise operation in a joysticking mode, in which a direction and magnitude of thrust of the marine propulsion device 36 are determined based on a position of a joystick 44. In that case, the method may further comprise modifying the operator demand prior to determining the engine speed setpoint to account for one of a gear ratio and a pitch of a propeller 16 of the marine propulsion device 36 when the marine propulsion system is operating in the joysticking mode. This method is described herein above with respect to FIG. 5.

In another example, the operating state comprises operation in a throttle-only mode, in which the operator demand can be varied while the engine 12 is in neutral. In this case, the method may further comprise determining whether the operator demand exceeds a predetermined threshold when the marine propulsion system is operating in the throttle-only mode, and if so, modifying the operator demand by capping it at the predetermined threshold prior to determining the engine speed setpoint. This method may further comprise multiplying the feed forward signal by a fractional gain when the marine propulsion system is operating in the throttle-only mode. This method is described herein above with respect to FIG. 6.

In another example, the operating state comprises one of acceleration of the engine speed and deceleration of the engine speed. In this example, the method may further comprise calculating a demand delta between a current operator demand and a previous operator demand, and using the demand delta and the engine speed setpoint to determine the authority limits. The method may further comprise filtering the previous operator demand to the current operator demand such that the demand delta progressively decreases, and using the decreasing demand delta and the engine speed setpoint to determine the authority limits. The method may further comprise providing the feedback controller with less authority to adjust the engine speed during deceleration of the engine speed than during acceleration of the engine speed. The method my further comprise providing the feedback controller 28 with increasingly more authority to adjust the engine speed as the demand delta progressively decreases. This method is described herein above with respect to FIGS. 7 and 8.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with one another and with other systems and methods. It is to be expected that various equivalents, alternatives and modifications are possible within the scope of the appended claims.

What is claimed is:

1. A method for setting an engine speed of an internal combustion engine in a marine propulsion device of a marine propulsion system to an engine speed setpoint, the method comprising:

determining the engine speed setpoint based on an operator demand;

predicting a position of a throttle valve of the engine that is needed to achieve the engine speed setpoint;

determining a feed forward signal that will move the throttle valve to the predicted position;

after moving the throttle valve to the predicted position, adjusting the engine speed with a feedback controller so as to obtain the engine speed setpoint; and determining an operating state of the marine propulsion system, wherein depending on the operating state, the method further comprises:

determining limits on an authority of the feedback controller to adjust the engine speed, wherein the authority limits comprise at least one of maximum and minimum proportional term limits and maximum and minimum integral term limits; and determining whether the operator demand should be modified prior to determining the engine speed setpoint when the operating state is a joysticking mode or a throttle-only mode.

2. The method of claim 1, wherein the operating state comprises operation in an operator-selected control mode, and further comprising selecting the authority limits based on the operator-selected control mode.

3. The method of claim 2, further comprising waiting to switch from a first operator-selected control mode to a second operator-selected control mode until the operator demand is less than an upper demand limit associated with the second operator-selected control mode.

4. The method of claim 1, wherein the operating state comprises operation in the joysticking mode, in which a direction and a magnitude of thrust of the marine propulsion device are determined based on a position of a joystick.

5. The method of claim 4, further comprising modifying the operator demand prior to determining the engine speed setpoint to account for one of a gear ratio and a pitch of a propeller of the marine propulsion device when the marine propulsion system is operating in the joysticking mode.

6. The method of claim 1, wherein the operating state comprises operation in the throttle-only mode, in which the operator demand can be varied while a transmission of the marine propulsion system is in neutral.

7. The method of claim 6, further comprising determining whether the operator demand exceeds a predetermined threshold when the marine propulsion system is operating in the throttle-only mode, and if so, modifying the operator demand by capping it at the predetermined threshold prior to determining the engine speed setpoint.

8. The method of claim 7, further comprising multiplying the feed forward signal by a fractional gain when the marine propulsion system is operating in the throttle-only mode.

9. The method of claim 1, wherein the operating state comprises one of acceleration of the engine speed and deceleration of the engine speed.

10. The method of claim 9, further comprising calculating a demand delta between a current operator demand and a previous operator demand, and using the demand delta and the engine speed setpoint to determine the authority limits.

11. The method of claim 10, further comprising filtering the previous operator demand to the current operator demand such that the demand delta progressively decreases, and using the decreasing demand delta and the engine speed setpoint to determine the authority limits.

12. The method of claim 11, further comprising providing the feedback controller with less authority to adjust the engine speed during deceleration of the engine speed than during acceleration of the engine speed.

13. The method of claim 11, further comprising providing the feedback controller with increasingly more authority to adjust the engine speed as the demand delta progressively decreases.

14. A marine propulsion system for setting an engine speed of an internal combustion engine in a marine propulsion device to an engine speed setpoint, the system comprising:

a throttle valve controlling an amount of air provided to the engine;

an input device for inputting an operator demand;

an electronic control unit that determines the engine speed setpoint based on the operator demand, predicts a position of the throttle valve that is needed to achieve the engine speed setpoint, and determines a feed forward signal that will move the throttle valve to the predicted position; and a feedback controller that adjusts the engine speed so as to obtain the engine speed setpoint after the throttle valve has been moved to the predicted position;

wherein the electronic control unit determines an operating state of the marine propulsion system; and wherein depending on the operating state, the electronic control unit further determines:

limits on an authority of the feedback controller to adjust the engine speed, wherein the authority limits comprise at least one of maximum and minimum proportional term limits and maximum and minimum integral term limits; and whether the operator demand should be modified prior to determination of the engine speed setpoint when the operating state is a joysticking mode or a throttle-only mode.

15. The marine propulsion system of claim 14, wherein the operating state comprises operation in an operator-selected control mode, and wherein the electronic control unit selects the authority limits based on the operator-selected control mode.

16. The marine propulsion system of claim 15, wherein the electronic control unit prevents a switch from a first operator-selected control mode to a second operator-selected control mode until the operator demand is less than an upper demand limit associated with the second operator-selected control mode.

17. The marine propulsion system of claim 14, wherein the input device comprises a joystick, and wherein the operating state comprises operation in the joysticking mode, in which a direction and a magnitude of thrust of the marine propulsion device are determined based on a position of the joystick.

18. The marine propulsion system of claim 17, wherein the electronic control unit modifies the operator demand prior to determining the engine speed setpoint to account for one of a gear ratio and a pitch of a propeller of the marine propulsion device when the marine propulsion system is operating in the joysticking mode.

19. The marine propulsion system of claim 14, wherein the operating state comprises operation in the throttle-only mode, in which the input device can be used to vary the operator demand while a transmission of the marine propulsion system is in neutral.

20. The marine propulsion system of claim 19, wherein the electronic control unit determines whether the operator demand exceeds a predetermined threshold when the marine propulsion system is operating in the throttle-only mode, and if so, modifies the operator demand by capping it at the predetermined threshold prior to determining the engine speed setpoint.

21. The marine propulsion system of claim 14, wherein the operating state comprises one of acceleration of the engine speed and deceleration of the engine speed.

22. The marine propulsion system of claim 21, wherein the electronic control unit calculates a demand delta between a current operator demand and a previous operator demand, and uses the demand delta and the engine speed setpoint to determine the authority limits.

23. The marine propulsion system of claim 22, wherein the feedback controller has less authority to adjust the engine speed during deceleration of the engine speed than during acceleration of the engine speed.

* * * * *